US005226619A

United States Patent [19]

Alger

[11] Patent Number: 5,226,619

[45] Date of Patent: Jul. 13, 1993

[54] ACTUATOR MECHANISM

[76] Inventor: Robert E. Alger, 1438 El Monte Dr., Thousand Oaks, Calif. 91362

[21] Appl. No.: 775,842

[22] Filed: Oct. 15, 1991

[51] Int. Cl.[5] ..... B61L 5/06; H01H 71/18

[52] U.S. Cl. ..... 246/219; 246/415 A; 323/234; 337/140; 60/528

[58] Field of Search ..... 246/415 R, 415 A, 218, 246/219, 221; 337/140; 323/234; 60/527-529

[56] References Cited

U.S. PATENT DOCUMENTS

| | | | |
|---|---|---|---|
| 2,969,919 | 1/1961 | Kornberg | 238/10 E X |
| 3,700,889 | 10/1972 | Edwards et al. | 246/415 A |
| 3,810,059 | 5/1974 | Jost | 337/140 X |
| 3,858,141 | 12/1974 | Lackey | 337/140 |
| 3,922,591 | 11/1975 | Olsen | 337/140 X |
| 4,016,721 | 4/1977 | Richardson et al. | 60/528 |
| 4,453,652 | 6/1984 | Merkel et al. | 222/504 |
| 4,517,543 | 5/1985 | Brubaker | 337/140 |
| 4,551,974 | 11/1985 | Yaeger et al. | 337/140 X |
| 4,553,393 | 11/1985 | Ruoff | 337/140 X |
| 4,700,541 | 10/1987 | Gabriel et al. | 337/140 X |
| 4,716,731 | 1/1988 | Sakai et al. | 60/527 |
| 4,806,815 | 2/1989 | Honma | 337/140 X |
| 4,932,210 | 6/1990 | Julien et al. | 60/528 X |
| 4,948,073 | 8/1990 | Edwards et al. | 246/415 A |
| 4,987,314 | 1/1991 | Gotanda et al. | 337/140 X |
| 5,061,914 | 10/1991 | Busch et al. | 60/527 X |

*Primary Examiner*—Michael S. Huppert
*Assistant Examiner*—Scott L. Lowe
*Attorney, Agent, or Firm*—Robert M. Sperry

[57] ABSTRACT

An electrically-controlled actuating mechanism comprises a length of shape memory wire. A source of electrical current passes electricity through the shape memory wire and a voltage regulator controls the voltage applied to the wire. The actuating mechanism is particularly advantageous as an actuator for a model railway track switch.

10 Claims, 1 Drawing Sheet

ACTUATOR MECHANISM

BACKGROUND

1. Field of Invention

This invention relates to actuator mechanisms and is particularly directed to electrically controlled means for selectably causing a mechanical motion having substantiaL tolerance and for assuring maintenance of that motion for a desired interval.

2. Prior Art

Electrically driven actuating mechanisms have long been known and are widely used for many purposes. Thus, for example, solenoids are widely used to control mechanical movement in a great many devices. However, most of these solenoid-controlled devices require abrupt mechanical movement from a first position to a second position and the locations of these positions must be quite precisely fixed. Also, solenoid devices are relatively noisy. However, for many purposes, smoothness of operation is preferred to speed and silence of movement is highly desirable. Furthermore, it may be desirable to allow considerable tolerance in the location of the first or second positions. One example of these problems is found in providing actuating means for model railroad switches. It is common practice, in model railroading, to construct a railroad layout incorporating components, such as track switches, produced by a plurality of manufacturers. Unfortunately, different manufacturers have developed track switches and track gauges which each have respective amounts of travel. Consequently, a switch actuator, which is intended for use with a plurality of such track switches, must have sufficient tolerance to accommodate these respective amounts of travel in order to properly close the track switch to control the direction of travel of the train and to prevent derailment. In the past, motorized actuation has been required to obtain such slow, smooth movements. Recently, shape memory wire has been used to produce such movement. Shape memory wire is an alloy of nickel and titanium, generally provided in the range of 4–10 mils diameter, having the property of rearranging its molecular and crystalline structure at a specific threshold temperature and returning to the original state upon cooling. The result of this rearrangement is a physical shortening of 4–5% of the length of the wire, although the volume remains constant. Moreover, the resulting motion is strong, smooth and silent. The most common method of obtaining the internal heating necessary is by the application of electric current directly to the wire. Unfortunately, overheating or interfering with the constricting motion has been found to cause stresses which damage or destroy the ability of the alloy to function in this manner. Thus, in the case of the model railroad track switch actuators, if an actuator, which was designed for a track switch having a large range of travel, is installed to control a track switch having a small range of travel, closing of the track switch will interfere with the constricting movement of the wire and, hence, will damage the actuator. On the other hand, an actuator which is designed for a track switch having a small range of travel will fail to properly close a track switch having a large range of travel and, hence, will either fail to control the direction of travel of the train or will cause derailment. Accordingly, none of the prior art actuating mechanisms have been entirely satisfactory.

BRIEF SUMMARY AND OBJECTS OF INVENTION

These disadvantages of the prior art are overcome with the present invention and an improved actuating mechanism is provided which is capable of strong, smooth, silent operation, yet which can accommodate substantial tolerance in its length of movement.

The advantages of the present invention are preferably attained by providing an electrically-controlled actuating mechanism comprising a length of shape memory wire, means for applying electrical current to said wire, and voltage regulating means connected in parallel with said wire.

Accordingly, it is an object of the present invention to provide an improved actuating mechanism.

Another object of the present invention is to provide an improved electrically-controlled actuating mechanism.

An additional object of the present invention is to provide an improved electrically-controlled actuating mechanism which is capable of strong, smooth, silent operation.

A further object of the present invention is to provide an improved electrically-controlled actuating mechanism which can accommodate substantial tolerance in its length of movement.

Another object of the present invention is to provide an improved actuating mechanism which is capable of strong, smooth, silent operation, yet which can accommodate substantial tolerance in its length of movement.

A specific object of the present invention is to provide an electrically-controlled actuating mechanism comprising a length of shape memory wire, means for applying electrical current to said wire, and voltage regulating means connected in parallel with said wire.

These and other objects and features of the present invention will be apparent from the following detailed description, taken with reference to the figures of the accompanying drawing.

DETAILED DESCRIPTION OF THE INVENTION

Figure 1:
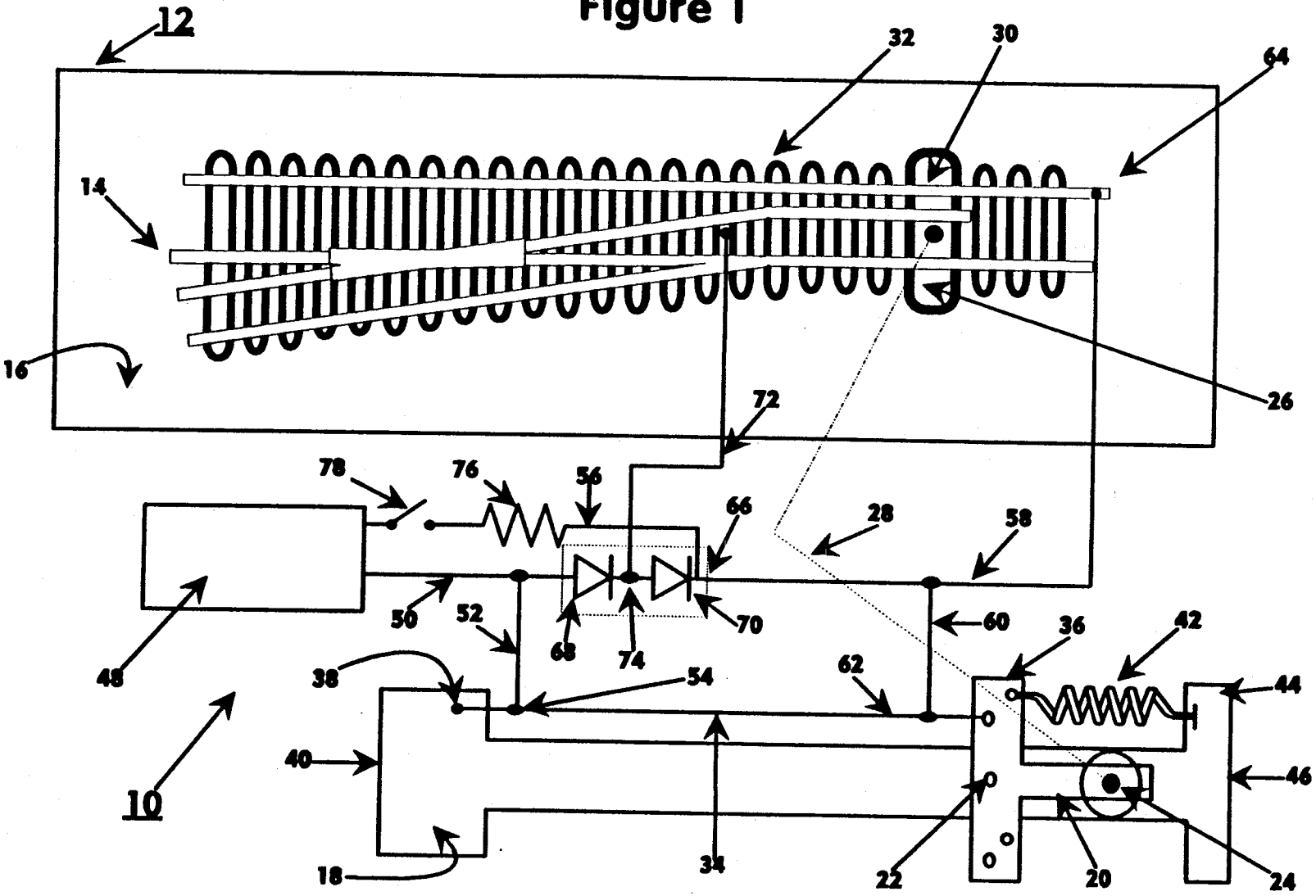
FIG. 1 is a diagrammatic representation showing an electrically-controlled actuating mechanism embodying the present invention shown actuating a model railroad switch.

In that form of the present invention chosen for purposes of illustration in the drawing, FIG. 1 shows an actuating mechanism, indicated generally at 10, mounted on the underside of a board 12 and serving to actuate a model railroad track switch 14 mounted on the upper surface 16 of the board 12. The actuating mechanism 10 comprises a base plate 18, formed of a suitable insulating material, such as plastic, which is secured to the underside of the board 12 by suitable means, such as glue, not shown. A generally T-shaped rocker 20 is pivotally secured to the base 18, as by pin 22, and carries an actuator arm 24 which projects upward, through a suitable slot 26 formed in the board 12, as indicated by dashed line 28, to engage the movable plate 30 which serves to position the switch point 32 of the track switch 14. A length of shape memory wire 34 is connected between one arm 36 of the rocker 20 and a projection 38, located adjacent one end 40 of the base 18, while resilient means, such as spring 42, is connected between arm 36 of the rocker 20 and a second projection 44, located adjacent the opposite end 46 of the base 18. A power source 48 is connected by wires 50 and 52 to one end 54 of the shape memory wire 34 and is connected by wires 56 58 and 60 to the opposite end 62 of the shape memory wire 34. Wire 58 is also connected to the main rail 64 of the model railroad track switch 14 and a voltage regulator 66 is connected between wires 50 and 58, in parallel with the shape memory wire 34, to regulate the voltage across the shape memory wire 34. As shown, the voltage regulator 66 comprises a pair of diodes 68 and 70, having a wire 72 connecting a point 74, between the diodes 68 and 70, with the switch point 32 of the track switch 14. Finally, a resistor 76 is connected into the wire 56 to restrict the current flow through the circuit and a control switch 78 is provided to control actuation of the actuator mechanism 10 and, hence, to control positioning of the switch point 32 of the track switch 14.

In use, to cause movement of the switch point 32 of the track switch 14, control switch 78 is closed, which causes power from the power source 48 to flow, through resistor 76 and wires 56, 58 and 60, to the shape memory wire 34 and, through wires 52 and 50, to complete the circuit. This voltage drop, preferably about 1.4 volts, causes internal heating of the shape memory wire 34, causing the shape memory wire 34 to contract, and causing arm 36 to pivot the rocker 20 about pin 22, moving actuator arm 24 and, hence, driving the movable plate 30 to move the switch point 32 of track switch 14 to its "closed" position. When switch point 32 contacts the main rail 64 of the track switch 14, a circuit is immediately completed, through wire 58, main rail 64, switch point 32 and wire 72, across diode 70 and causes the voltage across the shape memory wire 34 to fall to a lower value, such as 0.7 volts, which is sufficient to maintain the shape memory wire 34 in its contracted condition, yet serves to prevent overheating and possible damage of the shape memory wire 34. Since the circuit through diode 70 is completed immediately upon contact of the switchpoint 32 with the main rail 64 and serves to, immediately, drop the voltage across the shape memory wire 34, any variation in the range of travel of the switch point 32 will merely vary the time when the circuit across diode 70 is completed and, hence, when the shape memory wire 34 goes into its "holding" condition. Thus, variations in the range of travel of the switch point 32 will not interfere with the contraction of the shape memory wire 34 and no damaging stresses will be produced in the shape memory wire 34. If the switch point 32 should move away from the main rail 64 for any reason, the circuit across diode 70 will be immediately broken and the voltage across the shape memory wire 34 will return to the full value of 1.4 volts, reactivating the shape memory wire 34 to, again, contract and pivot rocker 20 and to, again, drive the movable plate 30 of the track switch 14 to cause the switch point 32 to recontact the main rail 64. Thus, the actuating mechanism 10 assures positive closure of the switch point 32 of any track switch 14, even where there is substantial variation in the range of travel of the switch point 32, and provides positive control of the direction of travel of the train across the switch 14, yet serves to protect the shape memory wire against damage from overheating or mechanical stress. Subsequently, when it is desired to reposition the switch point 32 of the track switch 14, control switch 78 is opened to break the circuit from the power source 48. This terminates the internal heating of the shape memory wire 34, which returns to its original length, and resilient means 42 assists return of arm 36 of the rocker 20 to its original position. This, in turn, causes the actuator arm 24 to drive the movable plate 30 of the track switch 14 to move the switch point 32 away from the main rail 64. Accordingly, a train traveling across the track switch 14 will now continue undiverted.

Obviously, numerous variations and modifications can be made without departing from the spirit of the present invention. Therefore, it should be clearly understood that the form of the present invention described above and shown in the accompanying drawing is illustrative only and is not intended to limit the scope of the present invention.

What is claimed is:

1. An electrically-controlled actuating mechanism comprising:

a length of shape memory wire, a device movable by said wire to accomplish a desired purpose, means for applying electrical current through said wire, and voltage regulating means connected in parallel with said wire and comprising a pair of diodes connected in parallel with said shape memory wire.

2. The actuating mechanism of claim 1 further comprising:

said pair of diodes comprising a first diode and a second diode connected in series with each other and in parallel with said shape memory wire, said device movable by said wire having a fixed member and a movable member, means electrically connecting said device across said second diode in a manner such that contact of said movable member with said fixed member will create an electrical shunt across said second diode.

3. The actuating mechanism of claim 2 further comprising:

a base, one end of said wire being secured to said base, a rocker member pivotally mounted on said base having a first arm connected to the opposite end of said wire and having a second arm extending at an angle to said first arm connected to said movable member of said device.

4. The actuating mechanism of claim 3 further comprising:

resilient means connected to said second arm of said rocker member to oppose movement of said second arm in a first direction by said wire and to facilitate movement of said second arm in a second direction.

5. The actuating mechanism of claim 4 wherein:

said resilient means is connected between said second arm of said rocker member and a portion of said base.

6. The actuating mechanism of claim 1 wherein:

said device is a model railroad track switch.

7. The actuating mechanism of claim 1 wherein:

said voltage regulating means is operable to apply a first voltage level across said wire to cause constriction of said wire.

8. The actuating mechanism of claim 7 wherein:

said voltage regulating means is resposive to movement of said device to drop the voltage across said wire to a lower level sufficient to maintain said wire in its contracted state without overheating.

9. An electrically-controlled actuating mechanism comprising:

a length of shape memory wire, a device movable by said wire to accomplish a desired purpose, means for applying electrical current through said wire, and voltage regulating means connected in parallel with said wire and operable to apply a first voltage of about 1.4 volts across said wire to cause constriction of said wire.

10. An electrically-controlled actuating mechanism comprising:

a length of shape memory wire, a device movable by said wire to accomplish a desired purpose, means for applying electrical current through said wire, and voltage regulating means connected in parallel with said wire and operable to apply a first voltage level of about 1.4 volts across said wire to cause constriction of said wire, said voltage regulating means being resposive to movement of said device to drop the voltage across said wire to a lower level of about 0.7 volts to maintain said wire in its contracted state without overheating.

* * * * *